US005884590A

United States Patent [19]

Minculescu

[11] Patent Number: 5,884,590

[45] Date of Patent: Mar. 23, 1999

[54] TWO-STROKE ENGINE

[76] Inventor: Mihai C. Minculescu, 52 Tamarack Ct., Newtown, Pa. 18940

[21] Appl. No.: 933,878

[22] Filed: Sep. 19, 1997

[51] Int. Cl.[6] ..... F02B 33/10

[52] U.S. Cl. ..... 123/71 R; 123/533; 123/55.7

[58] Field of Search ..... 123/71 R, 53.1, 123/53.3, 55.2, 55.6, 55.7

[56] References Cited

U.S. PATENT DOCUMENTS

| | | | |
|---|---|---|---|
| 3,981,280 | 9/1976 | Franke | 123/71 R |
| 4,138,972 | 2/1979 | Wilson | 123/71 R |
| 4,185,597 | 1/1980 | Cinquegrani | 123/71 R |
| 4,745,886 | 5/1988 | Yang | 123/71 R |
| 5,694,891 | 12/1997 | Liebich | 123/71 R |
| 5,791,303 | 8/1998 | Skripov | 123/71 R |

*Primary Examiner*—Marguerite McMahon
*Attorney, Agent, or Firm*—Gregory J. Gore

[57] ABSTRACT

An oscillating lever arm engine includes rigidly connected opposing pistons moved by a single lever connected to a rotating crankshaft. When applied to a two-cycle internal combustion engine, one piston may function as a pump piston and the second piston as a working piston which delivers power to the crankshaft through a connecting rod. When the pump piston is chosen to be of larger diameter, the volumetric efficiency of drawing in and providing the intake charge to the working piston may be increased. Furthermore, when poppet-type exhaust valves are used, valve timing may be selected so that the exhaust valves close before the cylinder wall transfer ports to achieve a supercharging effect.

11 Claims, 4 Drawing Sheets

TWO-STROKE ENGINE

FIELD OF THE INVENTION

The present invention relates to internal combustion engine structures and more particularly pertains to an oscillating lever arm engine for generating rotation torque through the oscillating movement of lever arms.

BACKGROUND OF THE INVENTION AND DESCRIPTION OF PRIOR ART

This invention is related to U.S. Pat. No. 5,572,904, entitled "Oscillatory Lever Arm Engine", by the same inventor. This previous patent similarly describes a lever arm engine with oscillating pistons generally of the type disclosed herein. This prior patent is hereby incorporated by reference as though fully set forth herein.

The use of many different types of internal combustion engine structures is known in the prior art. More specifically, internal combustion engine structures to convert rotary to reciprocating motion heretofore devised and utilized are known to consist basically of familiar, expected and obvious structural configurations, notwithstanding the myriad of designs encompassed by the crowded prior art which have been developed for the fulfillment of countless objectives and requirements.

Known prior art internal combustion engine structures include those disclosed in U.S. Pat. No. 5,255,572; U.S. Pat. No. 5,113,808; U.S. Pat. No. 5,067,456; U.S. Pat. No. 5,060,609; and U.S. Pat. No. 4,352,343.

While these devices fulfill their respective, particular objectives and requirements, the aforementioned patents do not disclose an oscillating lever arm engine for generating rotational torque through the oscillating movement of a lever arm which includes an elongated cylinder having a pair of pistons oppositely disposed within the cylinder, coupled together by a connecting rod with at least one lever arm pivotally mounted to the connecting rod between the pistons and also pivotally mounted at a medial portion thereof the exterior cylinder, wherein oscillating of the lever arm in response to the piston movement is translated into rotational movement of an adjacent flywheel.

Furthermore, the prior examples of oscillating piston devices, including pumps and compressors, do not take advantage of the possibilities for applying their advantages to two-cycle engines where there is a need to remove oil contamination presently used in two-cycle fuels. Additionally, it has gone completely unappreciated the possibilities for utilizing the advantages of an oscillating piston engine for supercharging a two-cycle engine or increasing the volumetric efficiency of the fuel/air charge delivered to the combustion chamber.

In these respects, the oscillating lever arm engine according to the present invention substantially departs from the conventional concepts and designs of the prior art, and in so doing provides an apparatus primarily developed for the purpose of generating rotational torque through the oscillating movement of only one lever arm.

SUMMARY OF THE INVENTION

Similar to the general concept presented in the embodiments disclosed in the previous U.S. Pat. No. 5,572,904, the present invention generally comprises an engine for generating rotational torque through the oscillating movement of a single lever arm. The inventive device includes an elongated cylinder having first and second opposed cylinder heads. A pair of pistons are oppositely disposed within the cylinder and coupled together by a connecting rod. A single lever arm is pivotally mounted at a first end thereof to the connecting rod between the pistons. The lever arm is also pivotally mounted at a medial portion thereof exterior of the cylinder to a mounting plate. A flywheel is rotatable mounted to the mounting plate and engages a second end of the lever arm, whereby oscillation of the lever arm in response to piston movement is translated into rotational movement of the flywheel.

This type of engine utilizing only a single lever arm as shown herein is employed in novel embodiments which will be later described in detail. These include the use of opposing pistons of different diameter where a larger first piston (hereinafter "pump piston") functions as a pump to supply the intake charge into transfer ducts and then through ports in the cylinder walls of the combustion chamber above a second combustion piston (hereinafter "working piston") to provide two-cycle operation. Because of the larger displacement of the pump utilizing the first piston, together with its inherent volumetric efficiency, a greater amount of intake charge is provided to the combustion space above the second working piston than can ordinarily be achieved by a crankcase-scavenged two-cycle engine. In this configuration, the two-cycle engine may employ either diesel or electric spark ignition and may utilize either direct fuel injection or carburetion. Furthermore, the control of the exhaust may be accomplished either by poppet valves or conventional cylinder wall exhaust porting. Air/fuel intake to the pumping side of the engine may be through the use of one-way reed-type valves. It will be readily appreciated that because the flow of fuel/air mixture is isolated from the crankcase and the spaces on the other side of the pistons that there is no need to add lubricating oil to the air/fuel mixture. This is an important advantage of the present invention. The various crankcase components are preferably lubricated by means well-known in the art of internal combustion engines, such as the means utilized in conventional four-cycle engines.

More specifically, the applicant has invented a two-cycle engine comprising an elongate cylinder block having opposing first and second coaxial cylinders. A first cylinder head is coupled to the end of the first cylinder, and a second cylinder head is coupled to the end of the second cylinder. First and second pistons are mounted within the first and second cylinders respectively and the pistons are connected by connecting rod so that they move in opposite directions. Lever means affixed to the connecting rod convert oscillating motion of the pistons into rotary motion of a single crankshaft. In operation, as a flywheel turns the crankshaft, an intake charge is drawn into a first pumping space between the first piston and the cylinder head and is passed by way of a transfer duct to a second combustion space between said second piston and said second cylinder head. The cylinder wall surrounding the second combustion space includes exhaust means whereby after ignition of the fuel charge in the second combustion space the pistons are driven against said lever means which in turn turns the crankshaft.

In one embodiment, the pistons are of different diameter to increase the volumetric efficiency and, thus, provide a greater intake charge to the second cylinder. A one-way valve may be included between the first pumping space and the transfer duct so that the intake charge will travel only in the direction into the duct and away from the pumping space. The exhaust means may either be an exhaust port cut into the cylinder wall of the second cylinder, or exhaust ports controlled by poppet valves in the second cylinder head.

Where poppet valves are used, they may advantageously be timed to close prior to the closing of the transfer port in the cylinder wall of the second cylinder.

It is therefore an object of the present invention to provide a new oscillating lever arm engine apparatus and method which has many of the advantages of the internal combustion engine structures mentioned heretofore and many novel features that result in an oscillating lever arm engine which is not anticipated, rendered obvious, suggested, or even implied by any of the prior art internal combustion engine structures, either alone or in any combination thereof.

It is another object of the present invention to provide an oscillating piston engine for use in two-cycle operation in which the crankcase space is isolated from the intake charge so that the fuel charge need not contain lubricating oil.

It is a further object of the present invention to provide a two-cycle engine with the possibility of supercharging in which a volume of fuel charge greater than that of the swept volume of the working piston is delivered to the combustion space throughout each operating cycle.

It is yet a further object of the present invention to provide the simplicity of a single lever oscillating piston reciprocating device which eliminates piston side thrust that may be employed as a pump or compressor. The device may be employed as an internal combustion engine pump or compressor. When used in the application of an internal combustion engine, the lever system provides high torque, even at low RPM.

It is another object of the present invention to provide an oscillating lever arm internal combustion engine which is capable of running on gas, diesel, alcohol, propane or hydrogen as possible fuels.

It is yet a further object of the present invention to create a reciprocating device which is very compact and lightweight, inexpensive to manufacture when considering both material used and labor for assembly.

These, together with other objects of the invention, along with the various features of novelty which characterize the invention, are pointed out with particularity in the claims annexed to, and forming a part of, this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof Such description makes reference to the annexed drawings wherein.

DESCRIPTION OF THE PREFERRED EMBODIMENT

The description of the preferred embodiment shown in the figures of drawing is shown only diagrammatically. However, it will be understood by those of skilled in the art how to select from among available design choices to construct the claimed device from these teachings. Further, for greater detail of the particular working structures that may be used in carrying out the claimed invention, reference may be made to applicant's U.S. Pat. No. 5,572,904 which is incorporated herein.

Figure 1:
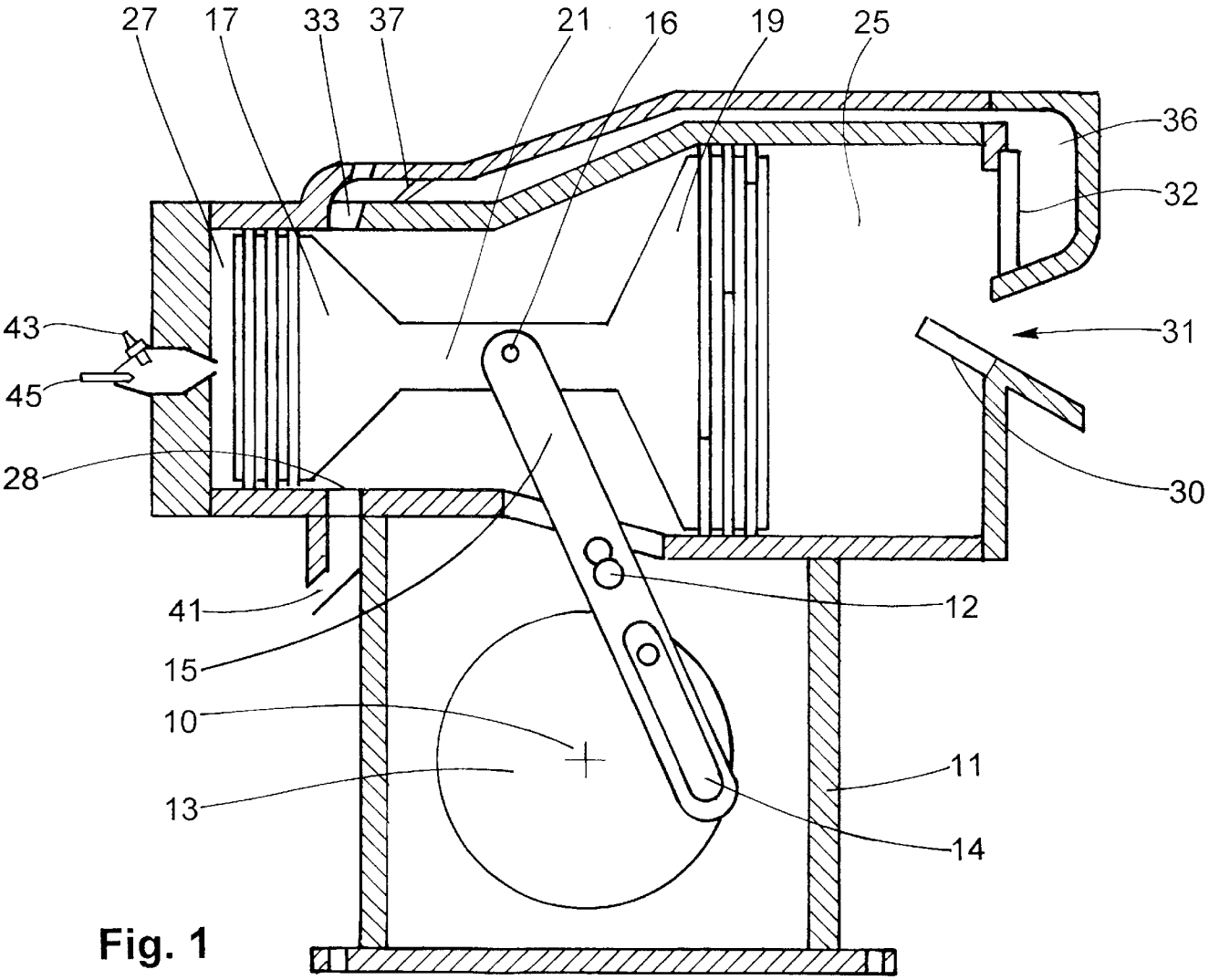
FIGS. 1 and 2 are front elevational partial cross-sectional diagrammatic views of the present invention.

Referring now to FIG. 1, an embodiment of the present invention is shown diagrammatically which includes cylinder block 11 that supports the various working components of the engine shown at top and bottom dead center for each piston. The crankshaft assembly 13, including a flywheel, is rotatably mounted within said crankcase about axis 10. Lever arm 15 includes a slot 14 at the lower end, and a pinned connection 16 to a connecting rod 21. As the crankshaft rotates, it will be understood that lever arm 15 rocks about fulcrum pin 12 which is rigidly affixed to the crankcase. The lever arm is further slotted in the area of pin 12 to permit the necessary longitudinal movement of the lever arm with respect to fulcrum pin 12. In this way, oscillatory motion of pistons 17 and 19 which are rigidly connected to connecting rod 21 is achieved as the crankshaft and flywheel rotate.

Figure 2:
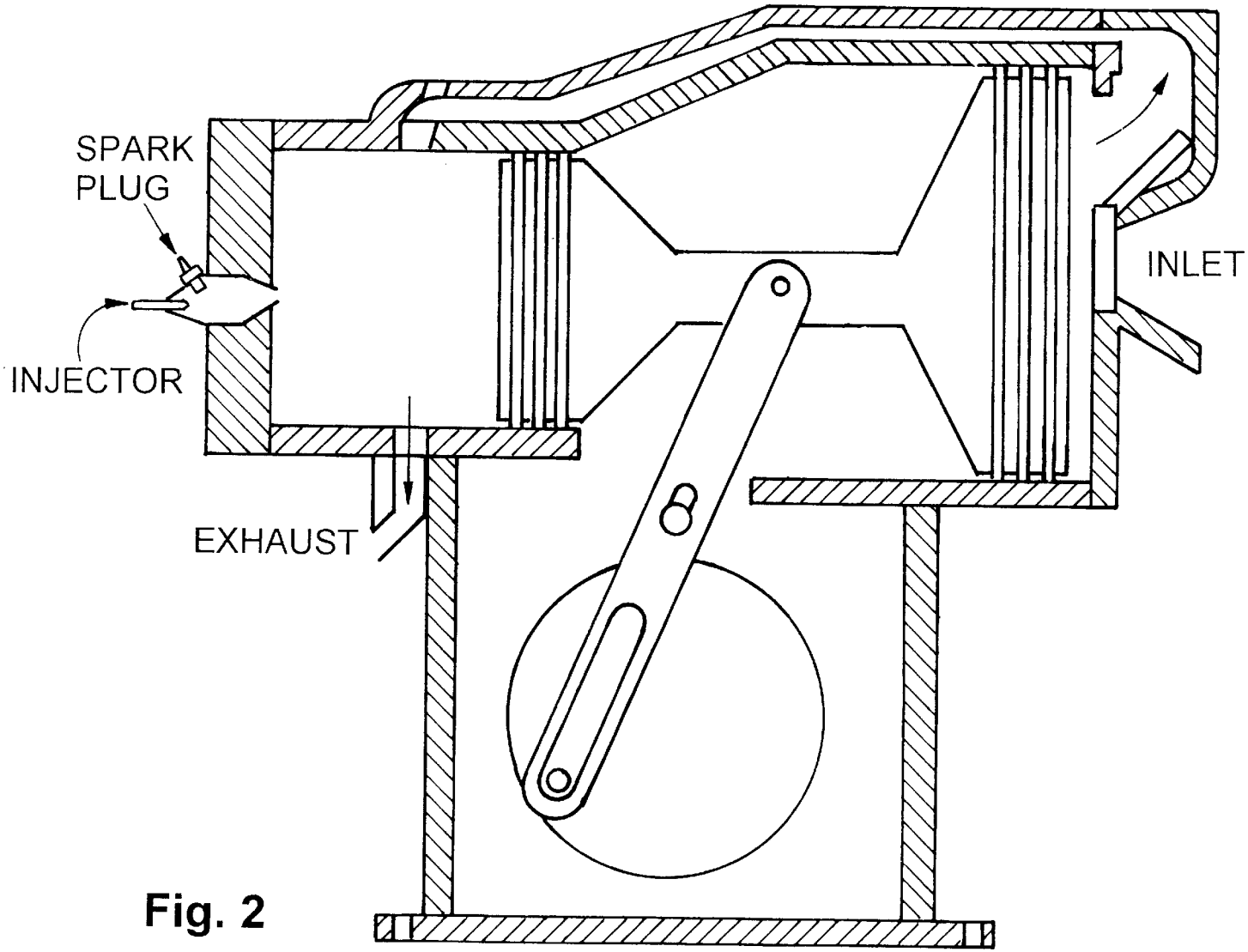

The engine depicted in this embodiment utilizes two-cycle operation; that is, one power stroke for each piston cycle. Two pistons 17 and 19 operate on opposite sides of the device, piston 17 functioning as a power-delivering piston and piston 19 functioning as a pumping piston. An intake charge, which may be an air/fuel mixture 31, enters the right side of the cylinder block through reed valve 30 which opens as a pump piston 19 moves to the left. As the pump piston returns its motion toward the right, reed valve 30 closes and valve 32 opens to permit the compressed air/fuel charge 33 to enter transfer duct 36. The charge is then delivered into the combustion chamber 27 above the power piston 17 through transfer port 33 in the cylinder wall. One-way valve means 37 may also be included in the transfer duct 36 in order to prevent blow-back. The cylinder wall around combustion space 27 also includes exhaust port 28 for expelling exhaust gases 41 after each power stroke. As an alternative to standard carburetion which mixes fuel and air prior to entering compressor chamber 25, direct fuel injection through injector 45 may be utilized. Furthermore, the ignition may be achieved by spark plug 43 or, in the alternative, diesel operation. In this embodiment, pump piston 19 has a greater diameter and, hence, a greater swept volume than combustion piston 17. This provides additional fuel charge volume to be supplied to combustion space 27 for greater power. FIG. 2 is the identical engine of FIG. 1, except with the crankshaft rotated so that the pistons are located in their extreme position to the right.

Figure 3:
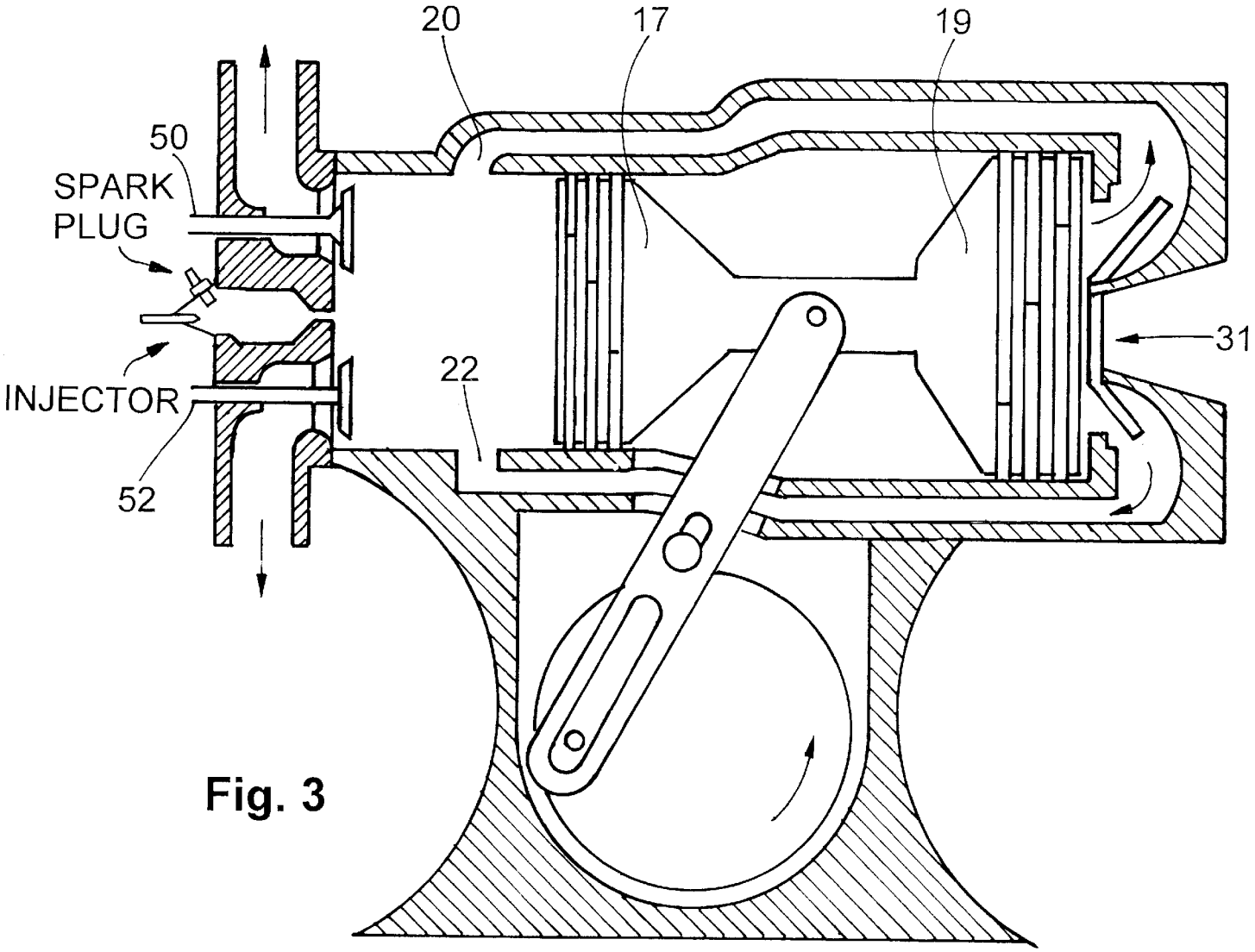
FIG. 3 is a front elevational partial cross-sectional diagrammatic views of an alternate embodiment of the present invention.

Referring now to FIG. 3, the same reciprocating components are utilized as described in FIGS. 1 and 2, in the same alternate piston positions, except that the control of the exhaust ports is effected by poppet valves 50 and 52. In this embodiment, the pump piston 19 is also of greater diameter than working piston 17 and, hence, it will be appreciated that if the exhaust valves are timed to close prior to the closing of the cylinder wall transfer ports 20 and 22, that a supercharging effect can be achieved. In this embodiment, dual transfer ducts are shown, each fed by a separate one-way pressure valve in the head of the pump side of the device. Intake 31 is controlled by a single one-way, reed-type valve as in the embodiment shown in FIG. 1. Similarly, either spark ignition with direct fuel injection, or diesel-type operation with direct fuel injection may be employed. In addition, the valves may be operated either mechanically or electrically.

Figure 4:
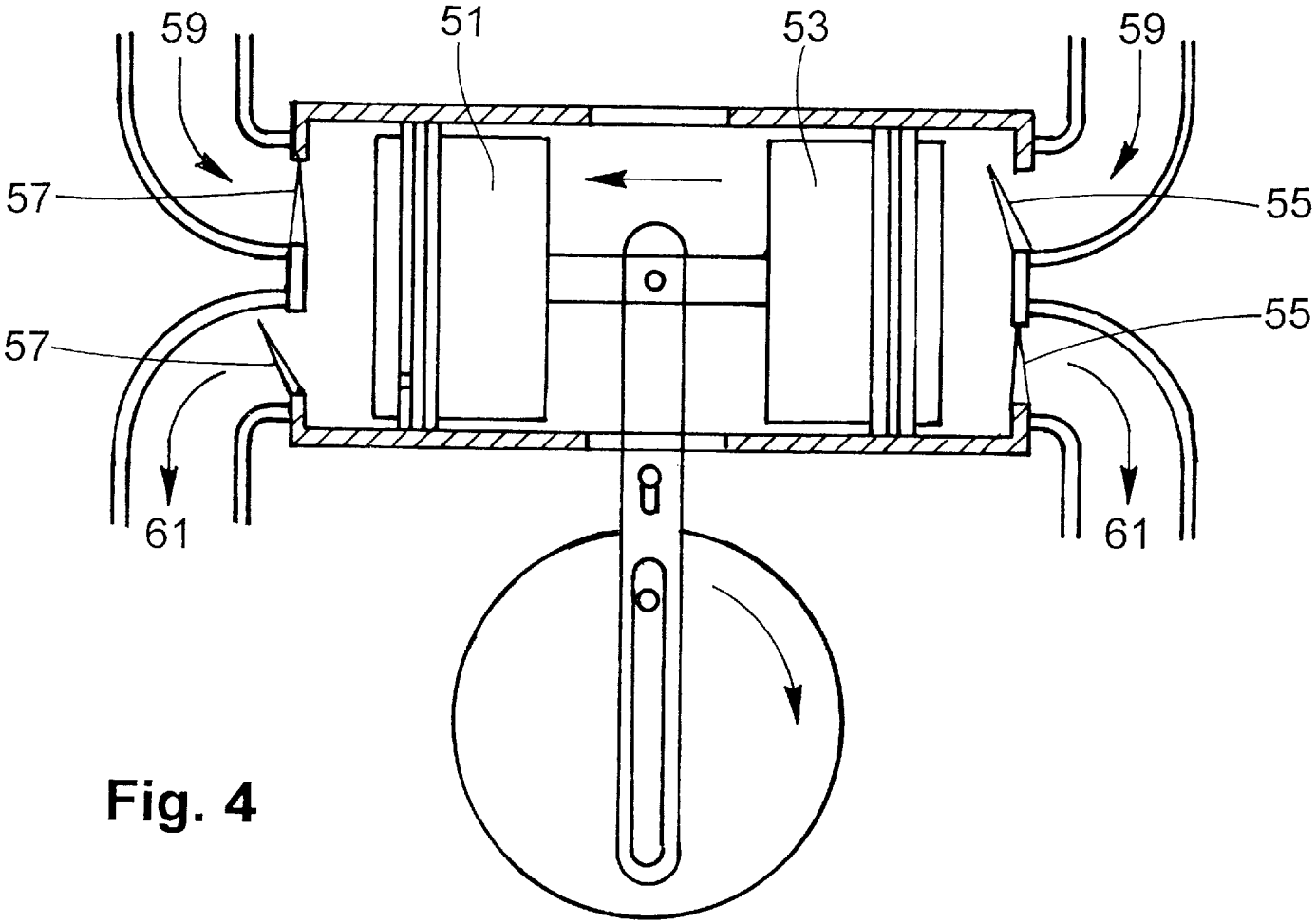
FIG. 4 is a front elevational partial cross-sectional diagrammatic view of an alternate embodiment of the present invention.

Referring now to FIG. 4, another embodiment is shown in which the basic operating structure of the present invention is applied to a twin-cylinder pump in which pistons 51 and 53, unlike the previous embodiments, are of equal diameter.

Each piston draws in and expels fluid 59 and 61 through one-way valves 55 for the right-band cylinder and one-way valves 57 for the left-hand cylinder.

By the mechanical relations described herein, it will be appreciated that the various objects of the present invention have been achieved. The present device provides an operating mechanism for a two-cycle internal combustion engine in which the crankcase space is isolated from the fuel charge so that the fuel need not contain lubricating oil. This provides the advantage of greater power and reduced environmental pollution from the exhaust. In addition, this two-cycle engine may include supercharging through the use of independently-timed exhaust valves and a pumping piston which has an operating volume greater than that of the combustion piston. Even without the use of valve timing that would permit supercharging, the present device permits greater power output due to increased fuel charge provided by the intake pumping means having an enlarged swept volume. These many advantages provide a great advancement over prior art engines which are not capable of achieving the same results.

It should be understood that the above description discloses specific embodiments of the present invention and are for purposes of illustration only. There may be other modifications and changes obvious to those of ordinary skill in the art that fall within the scope of the present invention which should be limited only by the following claims and their legal equivalents.

What is claimed is:

1. A two-cycle engine, comprising:

an elongate cylinder block having opposing first and second coaxial cylinders;

a first cylinder head coupled to the end of said first cylinder, and a second cylinder head coupled to the end of said second cylinder;

a first piston movably mounted in said first cylinder;

a second piston rigidly coupled to said first piston and movably disposed within said cylinder and facing in an opposite direction to said first piston;

a connecting rod extending between said first and said second pistons;

means affixed to said connecting rod for converting the oscillating motion of said pistons into rotary motion of a single crankshaft;

one-way valve means in said first cylinder head for controlling the flow of an intake charge into a first pumping space between said first piston and said first cylinder head;

a transfer duct in fluid communication with said first pumping space and a second combustion space between said second piston and said second cylinder head;

ignition means located in said second cylinder head; and exhaust means in fluid communication with said combustion space, whereby oscillation of said coupled pistons draws an intake charge into said pumping space and then forces said fuel charge from said pumping space through said duct means to said combustion space, wherein said second piston compresses said charge, and upon ignition, said ignited charge drives said second piston forceably, turning said crankshaft and wherein said means for converting the oscillation of said pistons to rotary motion of a single crankshaft, comprises a lever arm, rotatably and slidably mounted to said cylinder block.

2. The two-cycle engine of claim 1, wherein said pistons are of different diameter.

3. The two-cycle engine of claim 2, further including a one-way valve between said pumping space and said transfer duct which permits the intake charge to travel only in the direction into said duct and away from said pumping space.

4. The two-cycle engine of claim 3, wherein said exhaust means is an exhaust port in a cylinder wall of said second cylinder which is in fluid communication with said combustion space.

5. The two-cycle engine of claim 3, wherein said exhaust means are exhaust ports controlled by poppet valves in said second cylinder head.

6. The two-cycle engine of claim 5, further including a second one-way valve located in said transfer duct adjacent said transfer port.

7. A two-cycle engine, comprising:

an elongate cylinder block having opposing first and second coaxial cylinders;

a first cylinder head coupled to the end of said first cylinder, and a second cylinder head coupled to the end of said second cylinder;

a first piston movably mounted in said first cylinder;

a second piston rigidly coupled to said first piston and movably disposed within said cylinder and moved in an opposite direction to said first piston;

a connecting rod extending between said first and said second pistons;

means affixed to said connecting rod for converting the oscillating motion of said pistons into rotary motion of a single crankshaft;

one-way valve means in said first cylinder head for controlling the flow of an intake charge into a first pumping space between said first piston and said first cylinder head;

a transfer duct in fluid communication with said first pumping space and a second combustion space between said second piston and said second cylinder head;

ignition means located in said second cylinder head; and exhaust means in fluid communication with said combustion space, whereby oscillation of said coupled pistons draws an intake charge into said pumping space and then forces said fuel charge from said pumping space through said duct means to said combustion space, wherein said second piston compresses said charge, and upon ignition, said ignited charge drives said second piston forceably turning said crankshaft, wherein said exhaust means are exhaust ports controlled by poppet valves in said second cylinder head and wherein said poppet valves are timed to close prior to the closing of a transfer port in a cylinder wall of said combustion space, said transfer port being in fluid communication with said transfer duct.

8. The two-cycle engine of claim 7, wherein said pistons are of different diameter.

9. The two-cycle engine of claim 7, further including a one-way valve between said pumping space and said transfer duct which permits the intake charge to travel only in the direction into said duct and away from said pumping space.

10. The two-cycle engine of claim 9, wherein said exhaust means is an exhaust port in a cylinder wall of said second cylinder which is in fluid communication with said combustion space.

11. The two-cycle engine of claim 10, further including a second one-way valve located in said transfer duct adjacent said transfer port.

* * * * *